US012672686B2

(12) United States Patent
Newman

(10) Patent No.: US 12,672,686 B2
(45) Date of Patent: Jul. 7, 2026

(54) FITTED FACE MASK APPARATUS

(71) Applicant: Lighthouse Worldwide Solutions, Inc., Medford, OR (US)

(72) Inventor: Paul Newman, Grants Pass, OR (US)

(73) Assignee: Lighthouse Worldwide Solutions, Inc., Medford, OR (US)

( * ) Notice: Subject to any disclaimer, the term of this patent is extended or adjusted under 35 U.S.C. 154(b) by 0 days.

(21) Appl. No.: 17/182,834

(22) Filed: Feb. 23, 2021

(65) Prior Publication Data

US 2022/0264969 A1 Aug. 25, 2022

(51) Int. Cl.
*A41D 13/11* (2006.01)

(52) U.S. Cl.
CPC ..... *A41D 13/1107* (2013.01); *A41D 13/11* (2013.01); *A41D 13/1161* (2013.01)

(58) Field of Classification Search
CPC ..... A41D 13/1107; A41D 13/1161; A41D 13/11; A41D 13/1123; A62B 23/00; A62B 23/025; A62B 9/06; A62B 18/02; A62B 18/025
USPC ..... 128/205.29, 206.12, 2–6.13, 206.16, 128/206.27, 206.28, 206.21
See application file for complete search history.

(56) References Cited

U.S. PATENT DOCUMENTS 5,699,791 A * 12/1997 Sukiennik ..... A41D 13/1161 128/206.13
5,727,544 A * 3/1998 Miura ..... A41D 13/11 128/206.16
6,173,712 B1 * 1/2001 Brunson ..... A41D 13/1123 128/201.17
8,066,006 B2 * 11/2011 Daugaard ..... A41D 13/11 128/206.16
8,430,100 B2 * 4/2013 Reese ..... A41D 13/1107 128/206.19
D776,257 S * 1/2017 Remer ..... D24/110.1
D821,568 S * 6/2018 Nilsson ..... D24/110.1
11,116,999 B1 * 9/2021 Novosel ..... A41D 13/1161
(Continued)

FOREIGN PATENT DOCUMENTS

FR 2908050 A1 * 5/2008 ..... A41D 13/1123

OTHER PUBLICATIONS

FR 2908050 Nicholas Bugin, Respiratory Mask (May 9, 2008), Clarivate Analytics (pp. 1-5) (Year: 2008).*

*Primary Examiner* — Alissa L Hoey
*Assistant Examiner* — Akwokwo Olabisi Redhead
(74) *Attorney, Agent, or Firm* — Michael L. Greenberg, Esq.; Greenberg & Lieberman, LLC

(57) ABSTRACT

A face mask apparatus configured to more closely adhere to the face of the user such that it is fitted to the bridge of the nose to minimize any vision obstruction by a wearer. The face mask is equipped with a nose bridge segment, a mouth segment, and a chin segment, each disposed in serial communication at obtuse angles. A nose bridge support is disposed within a material of the nose bridge segment and is configured to ensure that the mask remains in position during movement of the face. Additionally, a secondary support is present within the mouth segment to ensure the mask is fitted to the face of the user for comfort and to ensure efficacy. The material of the mask is configured to filter bacteria, viruses, pollen, mold, dust, and other debris, and is preferably removably affixed to the face of the user via retention straps.

14 Claims, 3 Drawing Sheets

(56) References Cited

U.S. PATENT DOCUMENTS

| | | | | |
|---|---|---|---|---|
| 2002/0023651 | A1* | 2/2002 | Japuntich | A41D 13/11<br>128/206.15 |
| 2005/0139217 | A1* | 6/2005 | Chiam | A41D 13/1123<br>128/205.27 |
| 2009/0211582 | A1* | 8/2009 | Reese | A62B 23/025<br>128/206.21 |
| 2011/0155138 | A1* | 6/2011 | Lin | A41D 13/1115<br>128/206.19 |
| 2021/0153575 | A1* | 5/2021 | Hong | A41D 13/1107 |
| 2021/0162243 | A1* | 6/2021 | Yang | B32B 5/022 |
| 2021/0352976 | A1* | 11/2021 | Law | A41D 13/1161 |
| 2022/0072344 | A1* | 3/2022 | Scheiner | A41D 13/1161 |
| 2022/0110378 | A1* | 4/2022 | Tang | A62B 23/025 |
| 2022/0132949 | A1* | 5/2022 | Ambartsoumian | A41D 13/1161<br>128/206.19 |

* cited by examiner

FITTED FACE MASK APPARATUS

FIELD OF THE PRESENT INVENTION

The present invention relates to the field of personal protective equipment as used in the medical profession and others to prevent bacteria, viruses, dust, and debris from entering the respiratory system, and more specifically relates to a new form of face mask equipped with a flattened and fitted nose bridge portion which facilitates better visual clearance of the wearer to see down and past the mask when worn.

BACKGROUND OF THE PRESENT INVENTION

Personal protective gear (PPE) is known to include an assortment of items which are effective at minimizing the user's contact with potentially dangerous environments. The use of items such as masks, gloves, gowns, face shields, and the like are critical to the medical personnel conventionally known to be required to use such equipment in order to ensure that they remain healthy and able to treat new patients.

Unfortunately, face masks conventionally available today generally present an obstacle to the user as well as protection. Due to the nature of the way in which they adhere and conform to the face of the user, in a one-size-fits-all fashion, the wearer's vision is often partially obstructed due to the face mask itself, namely when the user looks downwards. This makes wearing face masks cumbersome, and can even lead to errors during work, such as during surgery as the surgeon is required to look down with caution to ensure accurate use of his or her hands. If there were a mask which could minimize or eliminate the mask's impedance on the vision of the wearer while remaining effective and comfortable, the wearer would find his or her job much easier to perform with accuracy, and vision would remain unobstructed.

Thus, there is a need for a new form of face mask apparatus configured to minimize or eliminate the material of the face mask within the line-of-sight of the user, namely when he or she looks downwards. Such an apparatus is preferably equipped with multiple segments disposed at varying angles in order to effectively adhere and cover the bridge of the nose of the wearer, as well as the mouth and chin areas.

SUMMARY OF THE PRESENT INVENTION

The present invention is a face mask apparatus configured to adhere to the face of a user constructively such that his or her vision is not obscured when looking downwards. The apparatus is equipped with at least two segments: a nose bridge segment and a mouth segment. Some embodiments exhibit a third segment disposed beneath the mouth segment, which is configured to conform towards the chin and/or neck of the user when worn.

The following brief and detailed descriptions of the drawings are provided to explain possible embodiments of the present invention but are not provided to limit the scope of the present invention as expressed herein this summary section.

BRIEF DESCRIPTION OF THE DRAWINGS

The accompanying drawings, which are incorporated herein and form a part of the specification, illustrate the present invention and, together with the description, further serve to explain the principles of the invention and to enable a person skilled in the pertinent art to make and use the invention.

The present invention will be better understood with reference to the appended drawing sheets, wherein.

DETAILED DESCRIPTION OF THE PREFERRED EMBODIMENT

The present specification discloses one or more embodiments that incorporate the features of the invention. The disclosed embodiment(s) merely exemplify the invention. The scope of the invention is not limited to the disclosed embodiment(s).

References in the specification to "one embodiment," "an embodiment," "an example embodiment," etc., indicate that the embodiment described may include a particular feature, structure, or characteristic, but every embodiment may not necessarily include the particular feature, structure or characteristic. Moreover, such phrases are not necessarily referring to the same embodiment, Further, when a particular feature, structure, or characteristic is described in connection with an embodiment, it is submitted that it is within the knowledge of one skilled in the art to effect such feature, structure, or characteristic in connection with other embodiments whether or not explicitly described.

Figure 1:
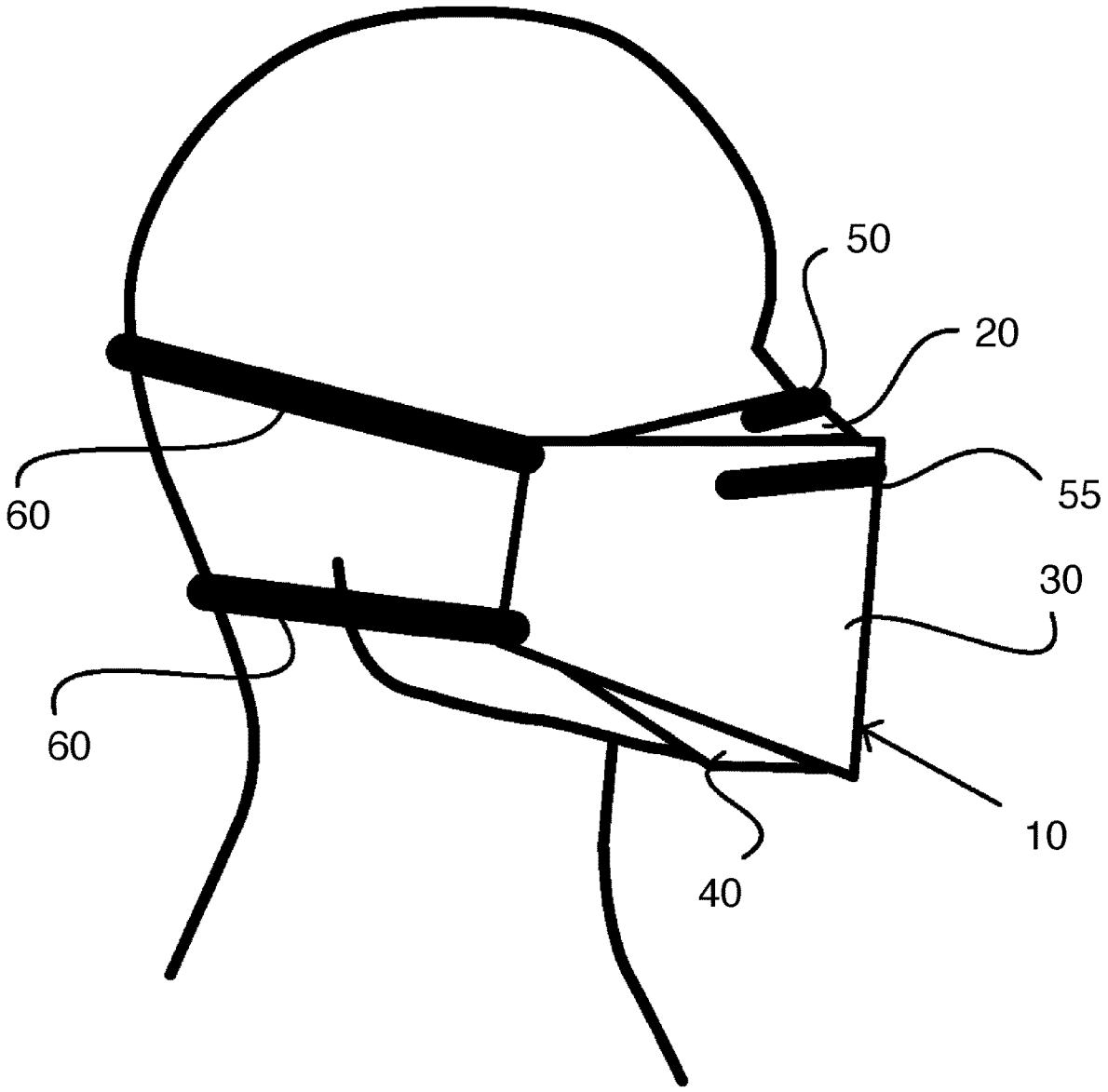
FIG. 1 depicts a view of the preferred embodiment of the face mask apparatus of the present invention as shown from the side.

The present invention is a face mask (10) configured to be worn on the face of a user to prevent transmission of viruses and bacteria, as well as to minimize inhalation of dust and debris. The face mask (10) is preferably equipped with three segments: a nose bridge segment (20), a mouth segment (30), and a chin segment (40), as shown in FIG. 1. The nose bridge segment (20) is configured to rest atop the bridge of the nose of the user. A nose bridge support (50) is preferably embedded within a material of the nose bridge segment (20) of the face mask (10). The nose bridge support (50) is preferably a pliable or semi-pliable piece of metal or plastic which ideally retains a shape once it is adjusted to the shape of the bridge of the nose of the user. Similarly, a primary support (55) is present beneath the nose bridge support (50), and is configured to help the face mask (10) as a whole adhere to the sides of the nose, and to ensure that the face mask (10) remains tightly in the preferred position as shown in FIG. 1.

The nose bridge segment (20) is disposed in communication with the mouth segment (30), and preferably abuts the mouth segment at an obtuse angle. The mouth segment (30) preferably partially overlaps the nose bridge segment (20) as shown in FIG. 1, helping to ensure adequate coverage of the point of the nose of the user when worn. Similarly, the chin segment (40) is disposed in communication with the mouth segment (30) and abuts the mouth segment (30) at a similar angle. However, the chin segment (40) is preferably configured to extend out and away from the mouth segment (30)

Retention straps (60) are present on sides of the face mask (10) and are configured to ensure that the face mask (10) remains in position over the nose and mouth of the user. The retention straps (60) are preferably fashioned of an elastic material and may be adjustable in length. Additionally, it should be understood that the retention straps (60) may be configured to extend around the rear of the head of the user or may be configured to loop around the ears of the user to ensure adequate retention of the face mask (10) to the face of the user.

In some embodiments of the present invention, only the nose bridge segment (20) and the mouth segment (30) are present on the face mask. In such embodiments, the mouth segment (30) is preferably tapered such that it angles down towards the chin of the user when worn.

It should be understood that the apparatus of the present invention is preferably fashioned of durable mesh material suitable for filtering contaminants including viruses, bacteria, pollen, mold, dust, and other debris. Some embodiments of the present invention may be equipped with multiple layers of material, with a specialized filter insert disposed (permanently or removable) in between the layers of material.

Figure 2:
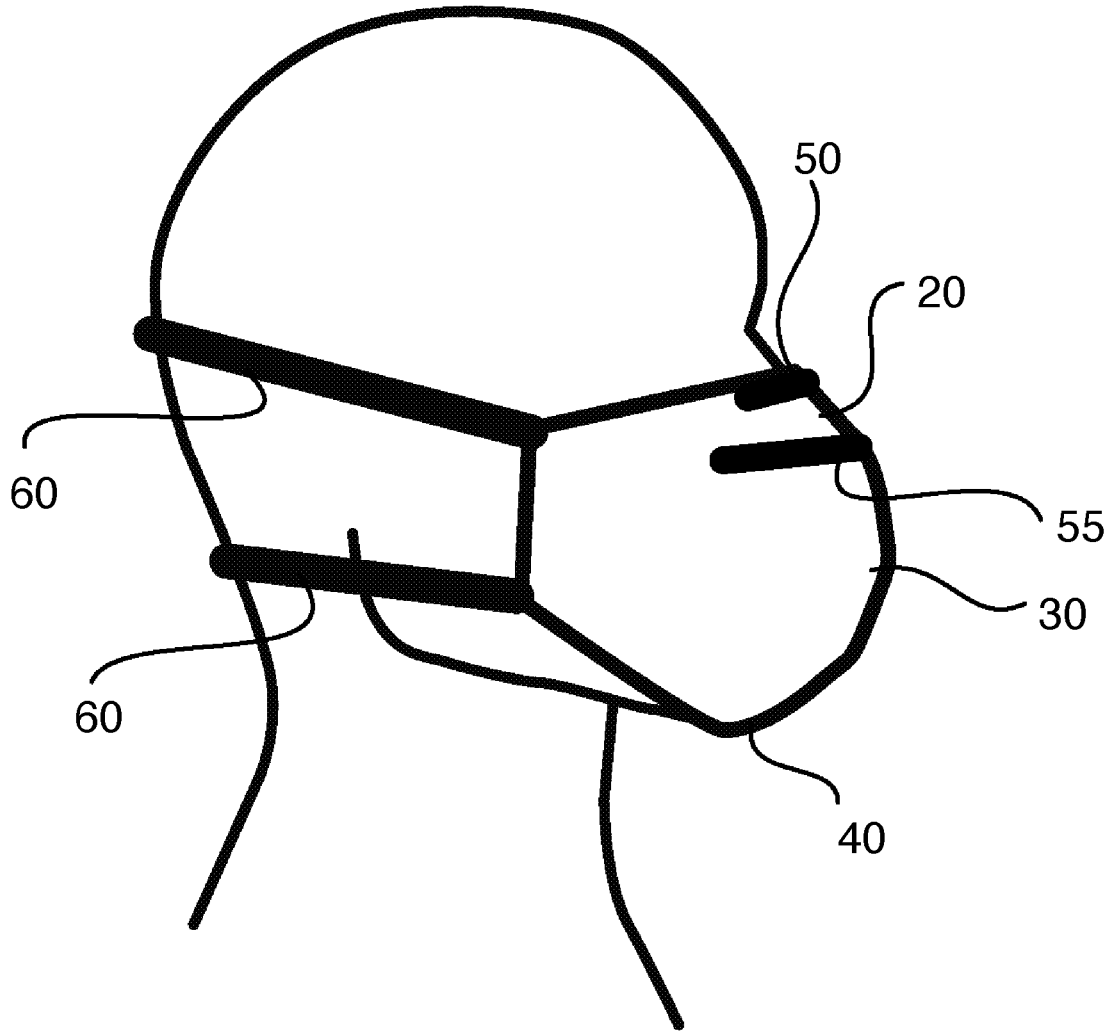
FIG. 2 exhibits a view of a second embodiment of the face mask apparatus of the present invention as shown from the side.
Figure 3:
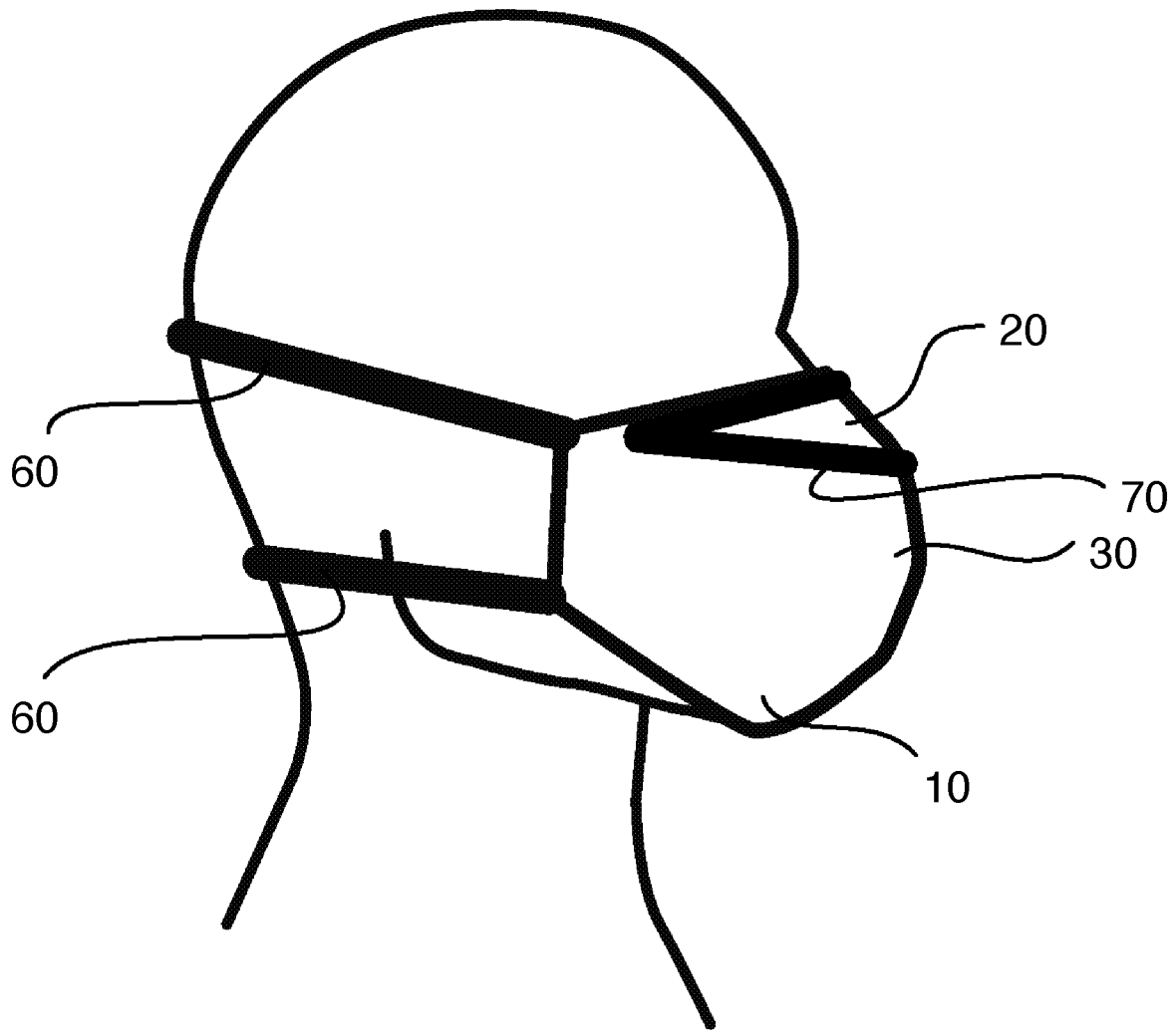
FIG. 3 shows a view of a third embodiment of the face mask apparatus of the present invention as shown from the side.

Alternate embodiments of the present invention are depicted in FIG. 2 and FIG. 3. As shown in FIG. 3, a unibody or joined support (70) is present, rather than the separated nose bridge support (50) and primary support (55) of the preferred embodiment of the present invention. The joined support (70) is preferably configured to extend along the sides of the mask such that it approaches the junction of the retention strap (50) and the mouth segment (30) of the face mask (10). In such embodiments, the delineation of the segments of the mask are softened for a more rounded appearance, however the nose bridge segment (20) and mouth segment (30) are still present within the structure of the apparatus in both alternate embodiments depicted in FIG. 2 and FIG. 3. The joined support (70), as shown in FIG. 3, exhibits an acute angle, joining a nose bridge support and a primary support with a singular unibody support, referenced as joined support (70).

It should be understood that the present invention is a face mask apparatus for a face of a user, having a mask body, a malleable first support, disposed on said mask body forward of the face of the user, a malleable second support, disposed on said mask body forward of the face of the user, wherein said first support and said second support are configured to hold said mask body against the user, wherein said first support and said second support are segments, wherein said first support is disposed on said mask body above said second support, wherein said first support and said second support are disposed equidistantly between a right side of said mask body and a left side of said mask body, wherein said first support and said second support are disposed toward a top half of said mask body, wherein said first support and said second support are disposed adjacent to one another, wherein said mask body has a first segment and a second segment, and wherein said first support is disposed on said first segment and said second support is disposed on said second segment.

Additionally, it should be understood that the present invention is a face mask apparatus for a face of a user, having a mask body, a first region of said mask body, a second region of said mask body, a third region of said mask body, a first support disposed between said first region and said second region, and a second support disposed between said second region and said third region as depicted in the Figures.

Having illustrated the present invention, it should be understood that various adjustments and versions might be implemented without venturing away from the essence of the present invention. Further, it should be understood that the present invention is not solely limited to the invention as described in the embodiments above, but further comprises any and all embodiments within the scope of this application.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment was chosen and described in order to best explain the principles of the present invention and its practical application, to thereby enable others skilled in the art to best utilize the present invention and various embodiments with various modifications as are suited to the particular use contemplated.

I claim:

1. A face mask apparatus for a face of a user, the face of the user including a nose, mouth, and chin, comprising:

a mask body, said mask body equipped with edges at which said mask body abuts the face of the user;

wherein said mask body comprises a first segment, a second segment, and a third segment, with said second segment being larger than said first segment and said third segment, and wherein said second segment is disposed centrally between said first segment and said third segment;

wherein said first segment slopes down and away from the face of the user when worn;

wherein said second segment presents a planar edge away from the face of the user when viewed from a side profile;

wherein said third segment is in communication with the chin of the user when worn;

wherein said first segment and said third segment are not vertical with respect to the face of the user while looking forward when worn;

a malleable first support, disposed on said mask body configured to be forward of the face of the user;

wherein said malleable first support terminates before approaching said edges;

a malleable second support, disposed on said second segment of said mask body configured to be forward of the face of the user;

wherein said malleable second support terminates before approaching said edges;

wherein said malleable first support and said malleable second support are linear when viewed from a right side of said mask body;

wherein said malleable first support and said malleable second support are linear when viewed from a left side of said mask body;

wherein said malleable first support is not parallel to said malleable second support;

wherein said malleable first support and said malleable second support are configured to hold said mask body against the face of the user;

wherein said malleable second support is a joined support disposed in communication with said malleable first support; and wherein said first support and said second support are solely disposed on a top half of said mask body.

2. The face mask apparatus of claim 1, wherein said malleable first support is disposed on said mask body above said second support.

3. The face mask apparatus of claim 2, wherein said first support and said second support are disposed equidistantly on a right side of said mask body and on a left side of said mask body.

4. The face mask apparatus of claim 1, wherein said malleable first support and said malleable second support are disposed equidistantly on a right side of said mask body and on a left side of said mask body.

5. The face mask apparatus of claim 4, wherein said first support and said second support are disposed adjacent to one another.

6. The face mask apparatus of claim 4, wherein said first segment is disposed directly atop said second segment;

wherein said first segment is disposed in communication with said second segment;

wherein said first segment is a nose segment configured to contour to the nose of the user; and wherein said first segment is smaller than said second segment.

7. The face mask apparatus of claim 6, wherein said first support is disposed on said first segment and said second support is disposed on said second segment.

8. The face mask apparatus of claim 4, wherein said first support and said second support are disposed adjacent to one another.

9. The face mask apparatus of claim 4, wherein said first segment is configured to be disposed over a nose bridge of the user, said second segment is configured to be disposed over a mouth of the user, and said third segment is configured to be disposed over a chin of the user.

10. The face mask apparatus of claim 9, wherein said first support is disposed on said first segment and said second support is disposed on said second segment.

11. The face mask apparatus of claim 1, wherein said malleable first support and said malleable second support are disposed adjacent to one another.

12. The face mask apparatus of claim 1, wherein said first segment is configured to be disposed over the nose of the user, and a said second segment is configured to be disposed over the mouth of the user;

wherein the first segment is smaller than said second segment;

wherein said second segment is tapered such that it angles down towards the chin of the user; and wherein said first segment abuts said second segment at an obtuse angle.

13. The face mask apparatus of claim 12, wherein said first support is disposed on said first segment.

14. The face mask apparatus of claim 12, wherein said first support is disposed on said first segment and said second support is disposed on said second segment.

* * * * *